US008100187B2

(12) United States Patent
Begnaud et al.

(10) Patent No.: US 8,100,187 B2
(45) Date of Patent: Jan. 24, 2012

(54) MULTIPURPOSE TUBULAR RUNNING TOOL

(75) Inventors: Brian David Begnaud, Youngsville, LA (US); Vernon J Bouligny, New Iberia, LA (US); Charles Michael Webre, Lafayette, LA (US)

(73) Assignee: Frank's Casing Crew & Rental Tools, Inc., Lafayette, LA (US)

( * ) Notice: Subject to any disclaimer, the term of this patent is extended or adjusted under 35 U.S.C. 154(b) by 300 days.

(21) Appl. No.: 12/414,645

(22) Filed: Mar. 30, 2009

(65) Prior Publication Data

US 2009/0314496 A1 Dec. 24, 2009

Related U.S. Application Data

(60) Provisional application No. 61/040,643, filed on Mar. 28, 2008.

(51) Int. Cl.
*E21B 19/20* (2006.01)
*E21B 23/00* (2006.01)

(52) U.S. Cl. ..... 166/381; 166/380; 166/77.1; 166/77.2; 166/77.51

(58) Field of Classification Search ..... 166/381, 166/77.1, 77.2, 77.51, 378
See application file for complete search history.

(56) References Cited

U.S. PATENT DOCUMENTS

| | | | | |
|---|---|---|---|---|
| 4,100,968 | A | 7/1978 | Delano | |
| 4,489,794 | A | 12/1984 | Boyadjieff | |
| 4,605,077 | A | 8/1986 | Boyadjieff | |
| 5,253,710 | A | 10/1993 | Carter et al. | |
| 5,735,348 | A | 4/1998 | Hawkins, III | |
| 5,850,877 | A | 12/1998 | Albright et al. | |
| 6,000,472 | A | 12/1999 | Albright et al. | |
| 6,142,545 | A | 11/2000 | Penman et al. | |
| 6,431,626 | B1 | 8/2002 | Bouligny | |
| 6,742,584 | B1 | 6/2004 | Appleton | |
| 7,140,443 | B2 | 11/2006 | Beierbach et al. | |
| 7,325,610 | B2 | 2/2008 | Giroux | |
| 7,337,853 | B2 | 3/2008 | Buytaert et al. | |
| 7,503,394 | B2 | 3/2009 | Bouligny | |
| 2004/0216924 | A1 | 11/2004 | Pietras et al. | |
| 2005/0000691 | A1 * | 1/2005 | Giroux et al. | 166/291 |

(Continued)

FOREIGN PATENT DOCUMENTS

CA 1239634 7/1988

(Continued)

OTHER PUBLICATIONS

PCT/US2009/38848; International Search Report and Written Opinion mailed Jan. 7, 2010.

(Continued)

*Primary Examiner* — Giovanna Wright
(74) *Attorney, Agent, or Firm* — Winstead PC; Henry L. "Bud" Ehrlich

(57) ABSTRACT

A tubular running tool includes a mandrel assembly having an upper mandrel, a lower mandrel and a mid-mandrel, wherein the upper mandrel, the lower mandrel and the mid-mandrel rotate in unison; the lower mandrel having a tubular gripping portion; a slip disposed with the tubular gripping portion; the mid-mandrel forming a bore between a top end and a bottom end, the top end forming a slip-joint with the upper mandrel; and an actuator mechanism disposed with the mid-mandrel, the actuator mechanism comprising a compensation actuator and a slip actuator; wherein the compensation actuator functionally connects the upper mandrel and the lower mandrel to affect axial movement of the lower mandrel relative to the upper mandrel and the slip actuator moves the slip into gripping engagement with a tubular.

39 Claims, 8 Drawing Sheets

U.S. PATENT DOCUMENTS

| | | | |
|---|---|---|---|
| 2006/0118293 | A1 | 6/2006 | Juhasz et al. |
| 2006/0124293 | A1 | 6/2006 | Juhasz et al. |
| 2007/0074876 | A1 | 4/2007 | Pietras |
| 2007/0131416 | A1 | 6/2007 | Odell, II et al. |
| 2008/0060818 | A1 | 3/2008 | Bourgeois et al. |
| 2008/0099196 | A1 | 5/2008 | Latiolais et al. |

FOREIGN PATENT DOCUMENTS

| | | |
|---|---|---|
| EP | 0171144 | 2/1986 |
| GB | 2347441 | 6/2000 |

OTHER PUBLICATIONS

750 Ton AC Top Drive TDS-8S, brochure, Varco Drilling Systems, date unknown.
500 Ton AC Top Drive TDS-11S, brochure, Varco Drilling Systems, date unknown.
Casing Drive System, Tesco, Bulletin 41000e, date unknown.

* cited by examiner 10
16
36
3
34
12
30
28
38
14
24
26
32
20
48
18
44
42

12a
94
84
84
92a
92
84
54
38
87
90
88
87
12b
X
X

MULTIPURPOSE TUBULAR RUNNING TOOL

RELATED APPLICATIONS

This application claims the benefit of U.S. Provisional Patent Application No. 61/040,643 filed Mar. 28, 2008.

TECHNICAL FIELD

The invention relates in general wellbore operations and more particular to devices and methods for running wellbore tubulars.

BACKGROUND

In the drilling and completion of wells it is necessary to run tubular strings into and out of the wellbore. The tubular strings are formed of various pipe types, weights, and diameters depending on the operation performed. In addition to running tubular strings into and out of the wellbore it is often necessary to rotate the tubular string. For example, it is often desired to drill the wellbore using casing. It is also desirable to rotate individual tubular joints for the purpose of making up threaded connections. It is therefore a benefit to provide devices and methods facilitating one or more of gripping tubulars, axially moving the tubulars, and rotating the tubular.

SUMMARY

In one embodiment a tubular running tool includes a mandrel assembly having an upper mandrel, a lower mandrel and a mid-mandrel, wherein the upper mandrel, the lower mandrel and the mid-mandrel rotate in unison; the lower mandrel having a tubular gripping portion; the mid-mandrel forming a bore between a top end and a bottom end, the top end forming a slip-joint with the upper mandrel; a compensation actuator functionally connecting the upper mandrel and the lower mandrel to affect axial movement of the lower mandrel relative to the upper mandrel; and a tubular manipulator having a pick-up elevator.

Another embodiment of a tubular running tool includes a mandrel assembly having an upper mandrel, a lower mandrel and a mid-mandrel, wherein the upper mandrel, the lower mandrel and the mid-mandrel rotate in unison; the lower mandrel having a tubular gripping portion; a slip disposed with the tubular gripping portion; the mid-mandrel forming a bore between a top end and a bottom end, the top end forming a slip-joint with the upper mandrel; and an actuator mechanism disposed with the mid-mandrel, the actuator mechanism comprising a compensation actuator and a slip actuator; wherein the compensation actuator functionally connects the upper mandrel and the lower mandrel to affect axial movement of the lower mandrel relative to the upper mandrel and the slip actuator moves the slip into gripping engagement with a tubular.

An embodiment of a method for connecting a tubular member to a tubular string includes the steps of: (a) providing a tubular running tool comprising a mandrel assembly having an upper mandrel, a lower mandrel and a mid-mandrel; the lower mandrel having a tubular gripping portion; a slip disposed with the tubular gripping portion; the mid-mandrel forming a bore between a top end and a bottom end, the top end forming a slip-joint with the upper mandrel; and an actuator mechanism disposed with the mid-mandrel, the actuator mechanism comprising a compensation actuator and a slip actuator; wherein the compensation actuator functionally connects the upper mandrel and the lower mandrel to affect axial movement of the lower mandrel relative to the upper mandrel and the slip actuator moves the slip into gripping engagement with a tubular; (b) connecting the upper mandrel to a shaft of a top drive; (c) positioning a pin end of an add-on tubular with a box coupling of a tubular string, the tubular string suspended in a wellbore from a spider; (d) actuating the slip actuator to grippingly engage the add-on tubular; (e) threading the pin end into the box coupling by applying torque and rotation from the top drive to the add-on tubular via the mandrel assembly; (f) maintaining the top drive and the upper mandrel in a vertically stationary position while threading the pin end into the box coupling and allowing the lower mandrel to move axially downward as the pin end is threaded into the box coupling; (g) lifting the interconnected add-on tubular and tubular string by moving the top drive and upper mandrel vertically; and (h) disengaging the spider from the tubular string.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
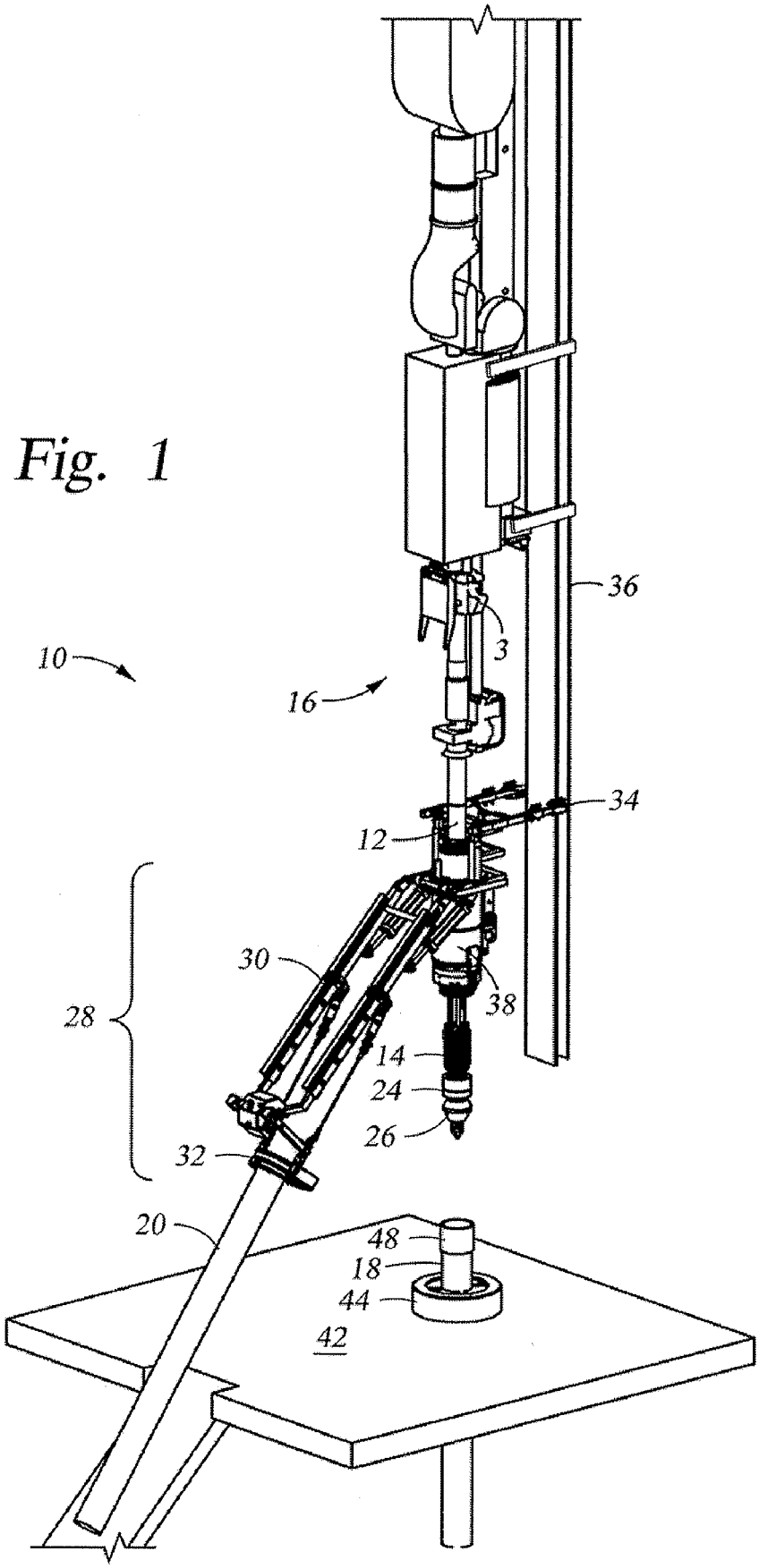
FIG. 1 is an elevation view of a multipurpose tubular running tool in accordance with an exemplary embodiment of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point such as the surface from which drilling operations are initiated.

FIG. 1 is an elevation view of a multipurpose tubular running tool 10 in accordance with an exemplary embodiment of the present invention. Multipurpose tubular running tool 10 may also be referred to herein as a tubular or casing running tool. Multipurpose tubular running tool 10 includes a mandrel assembly 12 operationally disposed with gripping members 14 for selectively gripping a tubular. In this embodiment mandrel assembly 12 is operationally connected to a top drive 16, illustrated by a top drive motor, to transfer torque and/or rotation from top drive 16 to the tubular member (e.g., tubular string 18, add-on tubular 20) engaged by gripping member 14. For example, when gripping member 14 is in gripping engagement with add-on tubular 20, top drive 16 may apply torque and/or rotation to add-on tubular 20 to threadedly connect it to tubular string 18, to disconnect add-on tubular 20 from tubular string 18, or top drive 16 may apply torque and/or rotation to tubular string 18 for drilling or related activities.

A flow path 22 (FIG. 2) is formed through tubular running tool 10 and top drive 16 in this embodiment. Tubular running tool 10 may further include a seal member 24 and a functional component 26. Seal member 24 is adapted to form a fluid seal with the tubular 18, 20 upon entry into the tubular. In this embodiment, seal member 24 is a cup seal adapted to sealing engage an internal diameter of a tubular. Functional component 26 is illustrated to represent various devices or tools that may be utilized with tubular running tool 10, such as and without limitation to, mud flow control valves, stabbing guides, gauge rings, cementing tools and the like.

In the embodiment of FIG. 1, multipurpose tubular running tool 10 includes a tubular manipulator 28 for transferring tubulars, such as add-on tubular 20, to a position to be connected with casing string 18. For example, tubular manipulator 28 may be utilized to transfer add-on tubular joint 20 from a non-vertical orientation, such as at the V-door area of the rig, to a vertical orientation proximate to the well center of the rig floor. Tubular manipulator 28 may include an arm 30 and single joint pick-up elevator 32. In the illustrated embodiment, arm 30 is extendable in length and is pivotally connected with mandrel assembly 12 via housing 38 in the illustrated embodiment. Various means other than the illustrated tubular manipulator 28 may be utilized to transfer tubular joints to the well area of the rig. One example of a tubular manipulator is disclosed in U.S. patent application Ser. No. 11/470,910 filed on Sep. 7, 2006, and published as U.S. Patent Application Publication No. 2008/0060818 on Mar. 13, 2008, which is incorporated herein by reference.

Multipurpose tubular running tool 10 includes a torque arrestor 34 that may be connected with a stationary (e.g., rotationally stationary) object, such as, and without limitation to, guide rails 36 of the top drive system or the bail ears 3 of top drive 16 system. In the embodiment of FIG. 1, arrestor 34 includes a pair of arms extending outward from tubular running tool 10 and contacting rails 36. In this example, arrestor 34 extends outward from a portion of tubular manipulator 28; however, arrestor 34 may extend from or be connected at various positions along tubular running tool 10.

Torque arrestor 34 is provided to hold some components of multipurpose tubular running tool 10 rotationally stationary and in a substantially fixed orientation relative to the Earth. For example, torque arrestor 34 may maintain tubular manipulator 28 and housing 38 rotationally stationary. As will be further understood with reference to the further Figures, multipurpose tubular running tool 10 includes rotating components, such as mandrel assembly 12 and gripping members 14; and components, such as housing 38 and tubular manipulator 28, that are rotationally independent of mandrel assembly 12.

Multipurpose tubular running tool 10, and methods of use, will be described generally herein in regard to adding one tubular member to another tubular member or string and lowering, or running, the interconnected tubulars into the wellbore. It is recognized that multipurpose tubular running tool 10 may be utilized to form and run a tubular string into a wellbore, to pull a tubular string from the wellbore, or to rotate a casing string disposed in the wellbore. Additionally, for purposes of description and brevity, the tubular utilized in the illustrated embodiments is referred to as casing.

Figure 1A:
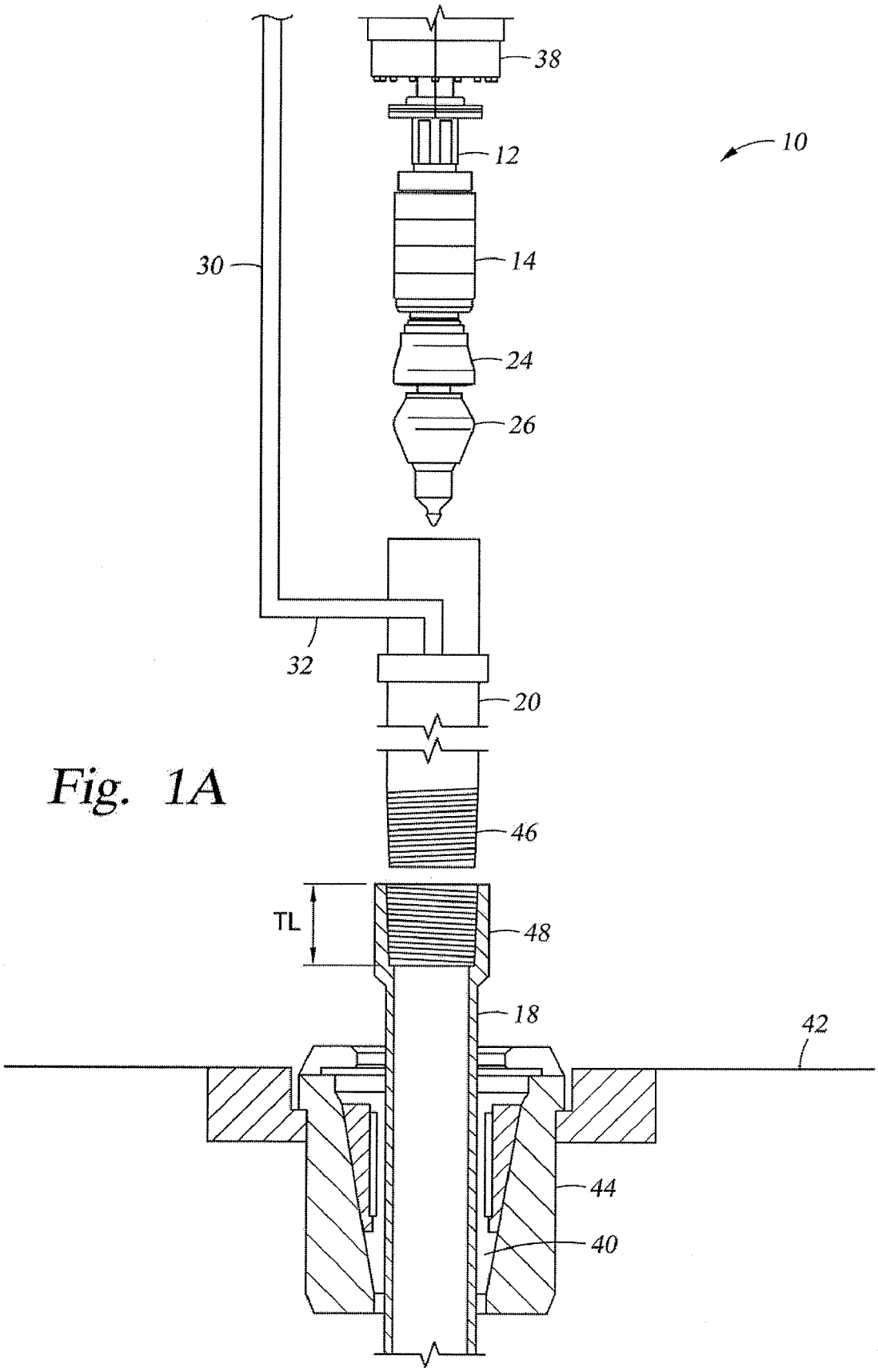
FIG. 1A is an elevation view of an add-on tubular positioned proximate to a tubular string.

Referring now to FIGS. 1 and 1A, a brief description of a manner of operating multipurpose tool 10 is described. Casing string 18 is suspended in wellbore 40 (e.g., borehole) by spider 44 (e.g., slips, rotary slips, etc.) proximate to the well surface, illustrated as rig floor 42. Add-on casino 20 is gripped by pick-up elevator 32 (FIG. 1). Top drive 16 and casing running tool 10 may be raised relative to floor 42 swinging add-on casing 20, via tubular manipulator 28, into a position substantially parallel to and axially aligned with mandrel assembly 12 and casing string 18 (FIG. 1A). The lower portion of mandrel assembly 12 and gripping members 14 are positioned proximate to the top, open end, of add-on casing 20 illustrated as a box coupling. It is noted that the "box coupling" of each tubular may be a unitary box coupling formed by the tubular body, or a coupling, attached to the tubular. Mandrel assembly 12 and pick-up elevator 32 may then be moved axially downward to position tubular pin connection 46 into threaded box connection 48. Once pin connection 46 is disposed in box connection 48, tubular running tool 10 may be further lowered so as to locate gripping members 14 into a gripping position relative to add-on tubular 20. In the illustrated embodiment, pickup elevator 32 slides down along add-on tubular 20 as tubular running tool 10 is axially lowered. In some embodiments, pickup elevator 32 is a side door elevator.

In FIG. 1A, the pin end 46 of add-on casing 20 is illustrated in the stab-in position relative to a box coupling 48 (e.g., coupling) of casing string 18. The distance of travel from the stab-in position to the full makeup position of the threaded connection of pin 46 and box coupling 48 is referred to as "thread loss" and is denoted by "TL". In some embodiments of multipurpose tubular running tool 10, as described further below, mandrel assembly 12 may be rotated to makeup the threaded connection without axially moving top drive 16 to compensate for the thread loss.

Figure 2:
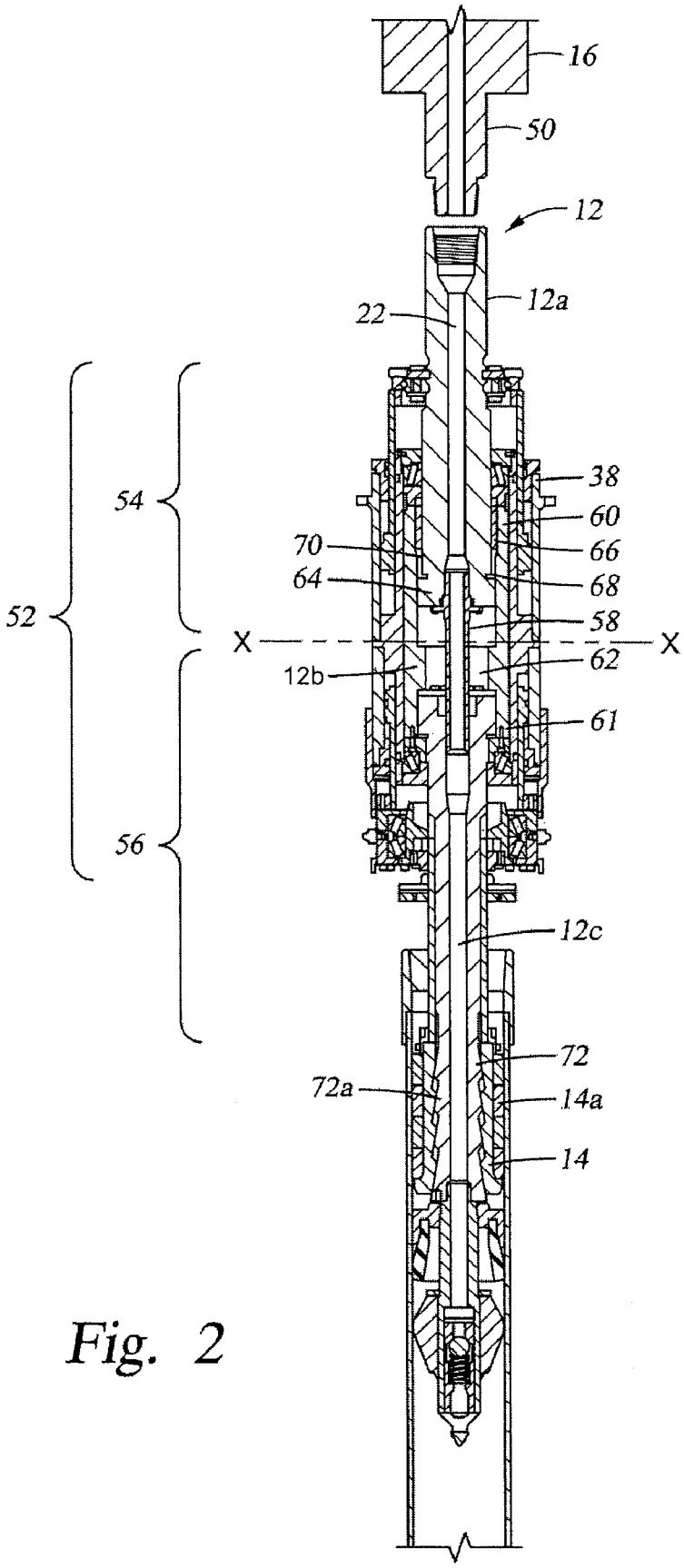
FIG. 2 is an elevation, sectional view of a tubular makeup portion of a multipurpose tool in accordance with an exemplary embodiment of the present invention.

Referring now to FIG. 2, a sectional view of a tubular makeup portion of multipurpose tubular running tool 10 in accordance with an exemplary embodiment is illustrated. Tubular manipulator 28 (FIG. 1) is not illustrated in this embodiment. Top drive 16 includes a shaft 50 having a bore forming a portion of fluid flow path 22 that extends through mandrel assembly 12. Multipurpose tubular running tool 10 includes mandrel assembly 12, gripping members 14, and an actuator mechanism 52. Actuator mechanism 52 includes a compensator 54 and a gripping member actuator 56 of housing 38 in this embodiment. For purposes of brevity and in accordance with the illustrated embodiments, gripping member 14 will be referred to generally as slips 14 and gripping member actuator 56 will be referred to as slip actuator 56.

Mandrel assembly 12 includes an upper mandrel 12*a*, mid-mandrel 12*b*, and a lower mandrel 12*c*. Mandrel assembly 12 provides fluid flow path 22 through its length. A stinger 58 provides the portion of flow path 22 extending between the internal bores of upper mandrel 12*a* and lower mandrel 12*c* in the illustrated embodiments. Upper mandrel 12*a* is threadedly connected to shaft 50 of top drive 16 in the illustrated embodiment and moves axially and rotationally in correspondence to movement of top drive shaft 50.

Mid-mandrel 12*b* has a top end 60 and a bottom end 61 forming an internal bore 62 therebetween. Top end 60 of mid-mandrel 12*b* is connected about a portion of upper mandrel 12*a* above the bottom, flared, end 64 of upper mandrel 12*a* forming a slip joint. Mid-mandrel 12*b* is connected with upper mandrel 12*a* in a manner such that it is axially moveable relative to upper mandrel 12*a* and rotates in unison with upper mandrel 12*a*. Thus, mid-mandrel 12*b* rotates in correspondence to rotation of upper mandrel 12*a* and is axially moveable relative to upper mandrel 12*a* via compensator 54. The functional connection of upper mandrel 12*a* and mid-mandrel 12*b* may include a spline connection and a load retainer 66 which is threadedly connected to mid-mandrel 12*b* in the illustrated embodiment.

Bottom, flared, end 64 of upper mandrel 12*a* has a larger diameter than the upper extending portion of upper mandrel 12*a* to form an upward oriented shoulder 68. Bottom, flared, end 68 is disposed within, and axially moveable along at least a portion of, internal bore 62 of mid-mandrel 12b. Mid-mandrel 12*b* forms a threaded portion of internal bore 62 proximate to top end 60, in which load retainer 66 has a downward oriented face 70 to contact shoulder 68 to complete an axial load path. In this embodiment, face 70 is shown formed by load retainer 66; however, face 70 may be formed in various manners.

Lower mandrel 12*c* and mid-mandrel 12*b* are fixedly connected to one another in this embodiment such that lower mandrel 12*c* and mid-mandrel 12*b* move axially and rotationally in unison. Lower mandrel 12*c* further includes a gripping section 72 at which slips 14 are disposed. In the illustrated embodiment, gripping section 72 comprises tapers 72*a*. Slips 14 are disposed on gripping section 72 such that axial movement of slips 14 relative to lower mandrel 12*c* moves slips radially relative to lower mandrel 12*c*. In this embodiment, axial downward movement (e.g., away from top drive 16) moves slips 14 outward for gripping engagement with the internal diameter of a tubular (e.g., add-on casing 20 or casing string 18 of FIG. 1). Axial movement of slips 14 is provided via slip actuator 56. In this embodiment, slips 14 include inserts 14*a* which may have a gripping surface (e.g., teeth).

Figure 2A:
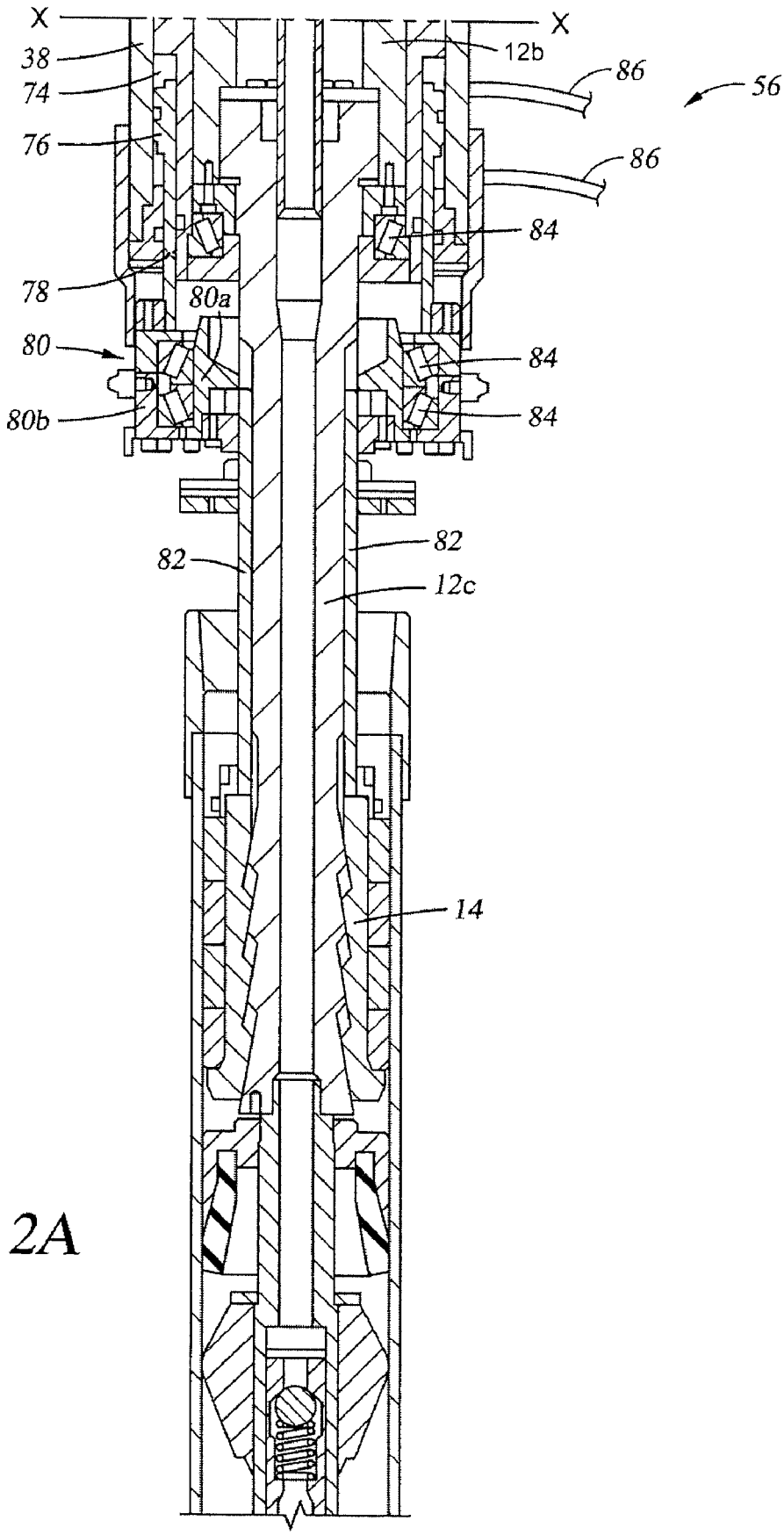
FIG. 2A is an expanded view of the slip actuator portion of the actuator mechanism of the multipurpose tubular running tool of FIG. 2.

Refer now to FIG. 2A wherein an expanded view of the portion of tubular running tool extending below the line X-X of FIG. 2 is provided to describe slip actuator 56. In this embodiment, slip actuator 56 includes a cylinder 74 (e.g., annular chamber) formed by housing 38 in which the head 76 of a cylinder rod 78 is disposed. Slip actuator 56 may be hydraulically or pneumatically actuated in the illustrated embodiment. For example, pressurized fluid (e.g., air, hydraulic fluid) may be added and released from cylinder 74 via hose(s) 86. Although not illustrated other actuators, including electric actuators and the like may be utilized.

Cylinder rod 78 extends from cylinder 74 and is connected to slips 14 via collar 80 and push rods 82. Collar 80 includes an inner portion 80*a* that is functionally connected with lower mandrel 12*c* and push bars 82 in a manner such that portion 80*a* and bars 82 rotate with lower mandrel 12*c* and are axially moveable relative to lower mandrel 12*c*. Collar 80 includes an outer portion 80*b* that is connected with cylinder rod 78 and with collar portion 80*a* via bearings 84.

Figure 2B:
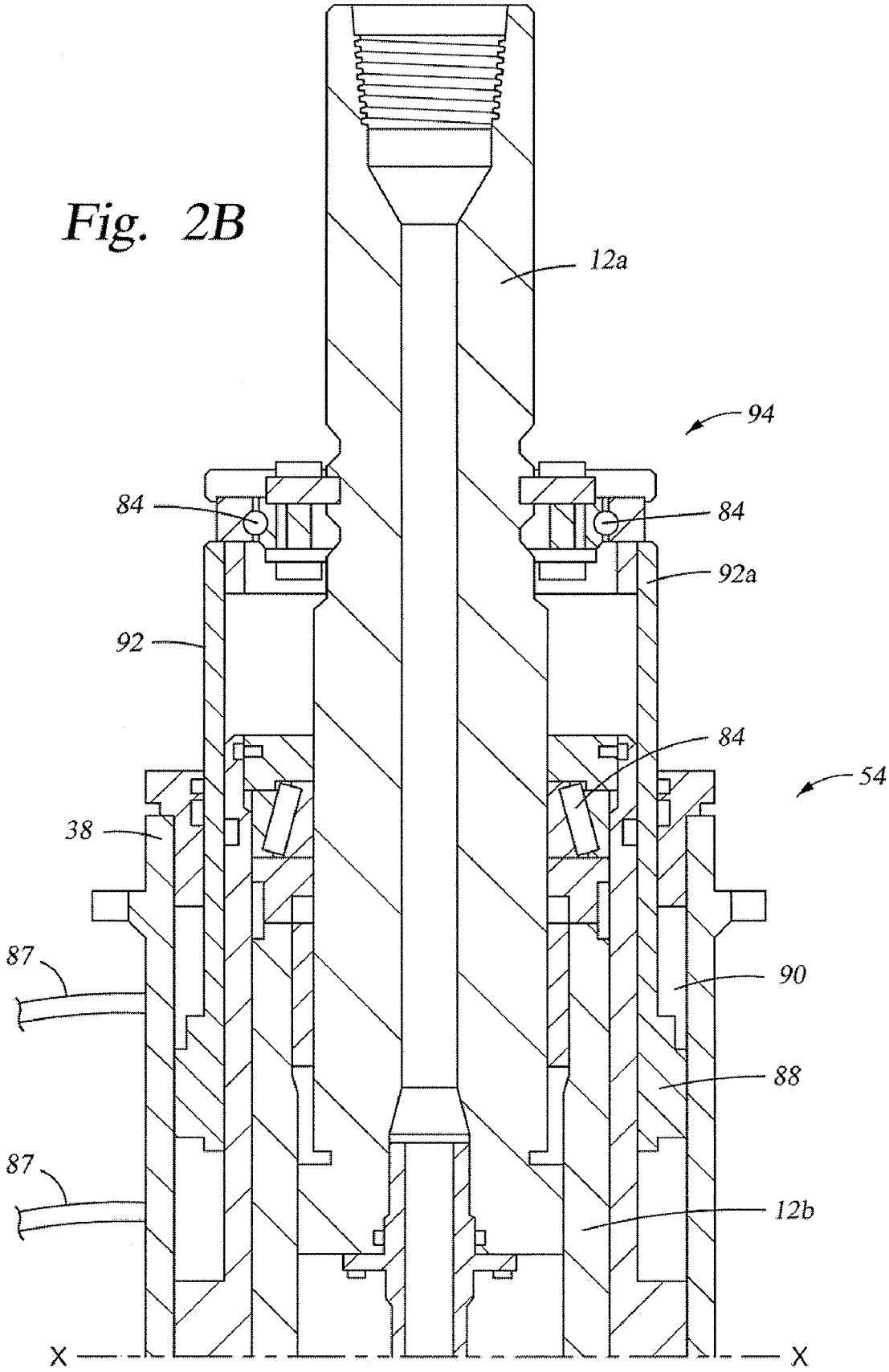
FIG. 2B is an expanded view of the compensator actuator portion of the actuator mechanism of the multipurpose tubular running tool of FIG. 2.

Refer now to FIG. 2B wherein an expanded view of the portion of tubular running tool extending above the line X-X of FIG. 2 is provided to describe compensator 54. Compensator 54 is an actuator functionally connecting upper mandrel 12*a* with mid-mandrel 12*b* and lower mandrel 12*c*. In the embodiment of FIG. 2, compensator 54 includes a piston head 88 disposed in cylinder 90 (e.g., annular chamber) formed by housing 38. The end 92*a* of piston 92 that is distal from piston head 88 is functionally connected to upper mandrel 12*a*. In the illustrated embodiment of FIG. 2, functionally connected is used to mean that distal end 92*a* is connected in an axial fixed position relative to upper mandrel 12*a* and is rotationally independent of upper mandrel 12*a*. In this embodiment, distal end 92*a* is connected to upper mandrel 12*a* by a mechanical bearing collar 94. The inner portion of collar 94 is connected to the outer portion of collar 94 via a bearing 84. The inner portion of collar 94 rotates with mandrel 12 and the outer portion is free to be held rotationally stationary relative to the mandrel 12. Compensator 54 (e.g., actuator) may be provided in various forms and may be actuated, for example and without limitation, electrically, hydraulically and pneumatically. In the illustrated embodiment, pressurized fluid (e.g., air, hydraulic fluid) may be added and released, for example via hoses 87, from cylinder 90 in to achieve the desired load compensation.

Referring to FIGS. 2, 2A and 2B in particular, housing 38 of actuator mechanism 52 is functionally connected about mandrel assembly 12. Housing 38 is disposed about mid-mandrel portion 12*b* in the illustrated embodiment in an axially fixed position relative to mid-mandrel 12*b* and lower mandrel 12*c*. Housing 38 is further connected with mandrel assembly 12 so as to be rotationally independent of mandrel assembly 12. For example, when mandrel assembly 12 is rotated, housing 38 remains rotationally stationary relative to the rig in the illustrated embodiments. Housing 38 may be held rotationally stationary in various maimers including by arrestor aims as described in the embodiment of FIG. 1.

Embodiments of the operation of multipurpose tubular running tool 10 are now described with reference to FIGS. 1-5. In the illustrated embodiments, compensator 54 may provide tool and/or joint compensation. Compensator 54 biases the lower portion of mandrel assembly 12 (e.g., mid-mandrel 12*b*, lower mandrel 12*c*) upward (e.g., toward top drive 16). For tool compensation, in one embodiment, compensator 54 provides an upward bias approximate the weight of the lower (e.g., axially moveable) portion of the tool. For example, actuator 54 provides sufficient force to bias mid-mandrel 12*b*, lower mandrel 12*c*, and actuation mechanism 52. For joint compensation, compensation actuator 54 may be biased upward by a force sufficient to also carry the weight of the tubular joint (e.g., add-on casing 20) being added to the tubular string. As will be further described, compensator 54 provides a means to threadedly connect add-on casing 20 with casing string 18 without vertically (e.g., axially) moving top drive 16 while making up the connection. Vertically moving the top drive, while rotationally connecting the tubulars, due to thread loss is referred to as chasing the joint. As may not be readily recognized, vertically moving the top drive components within the limitations of the thread loss distance can be difficult and often results in damage to the tubulars.

Figure 3:
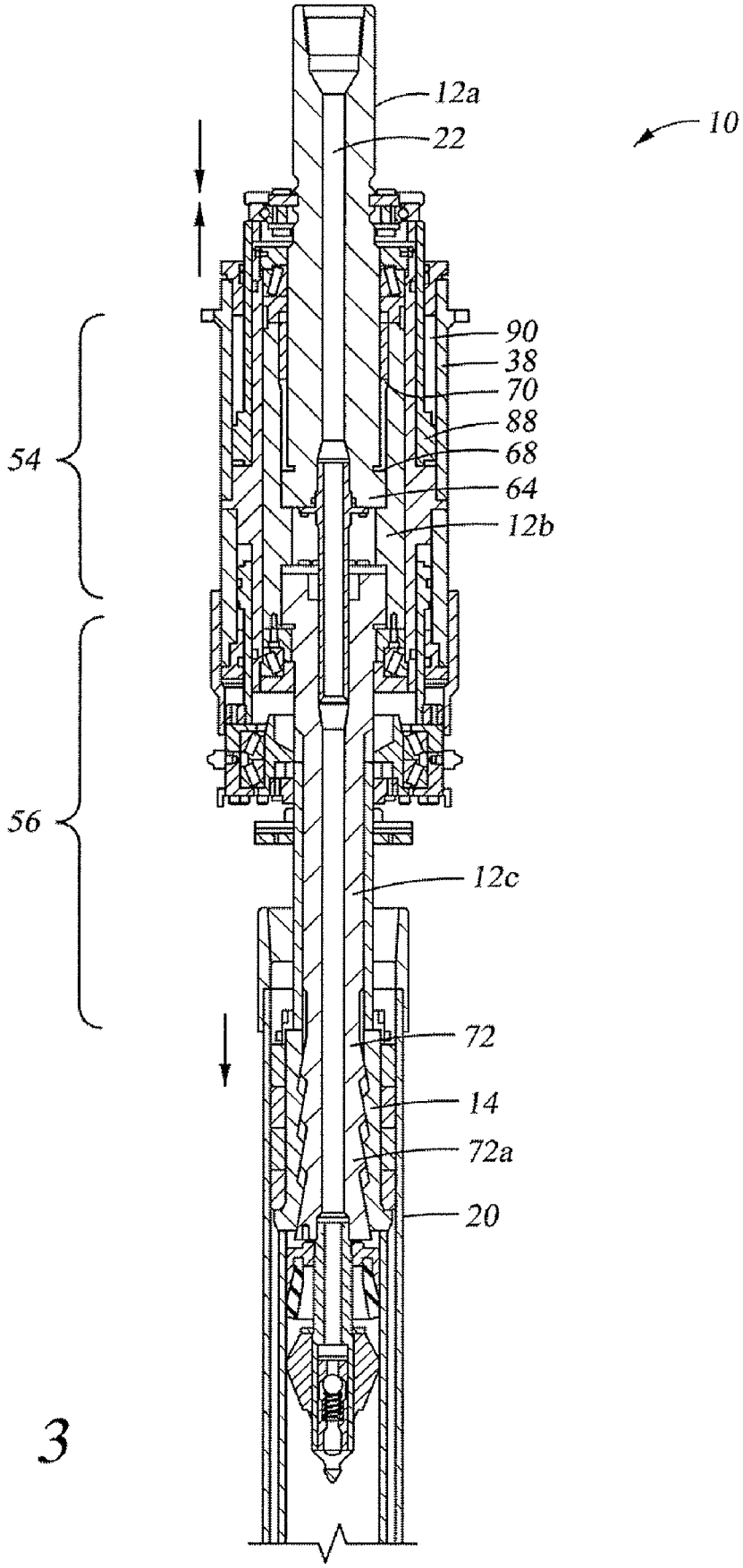
FIG. 3 is an elevation, sectional view of multipurpose running tool in an operational position.

Refer now to FIG. 3, wherein a tubular makeup portion of multipurpose tubular running tool 10 is illustrated in an operational position. Gripping section 72 of lower mandrel 12*c* is disposed inside of add-on casing joint 20. Slip actuator 56 is actuated to move slips 14 axially along tapers 72*a* and radially outward from lower mandrel 12*c* into gripping contact with the interior surface of add-on casing 20. Compensator 54 is in a retracted position in FIG. 3 wherein upper mandrel 12*a* is fully retracted into lower mandrel 12*b*.

Figure 4:
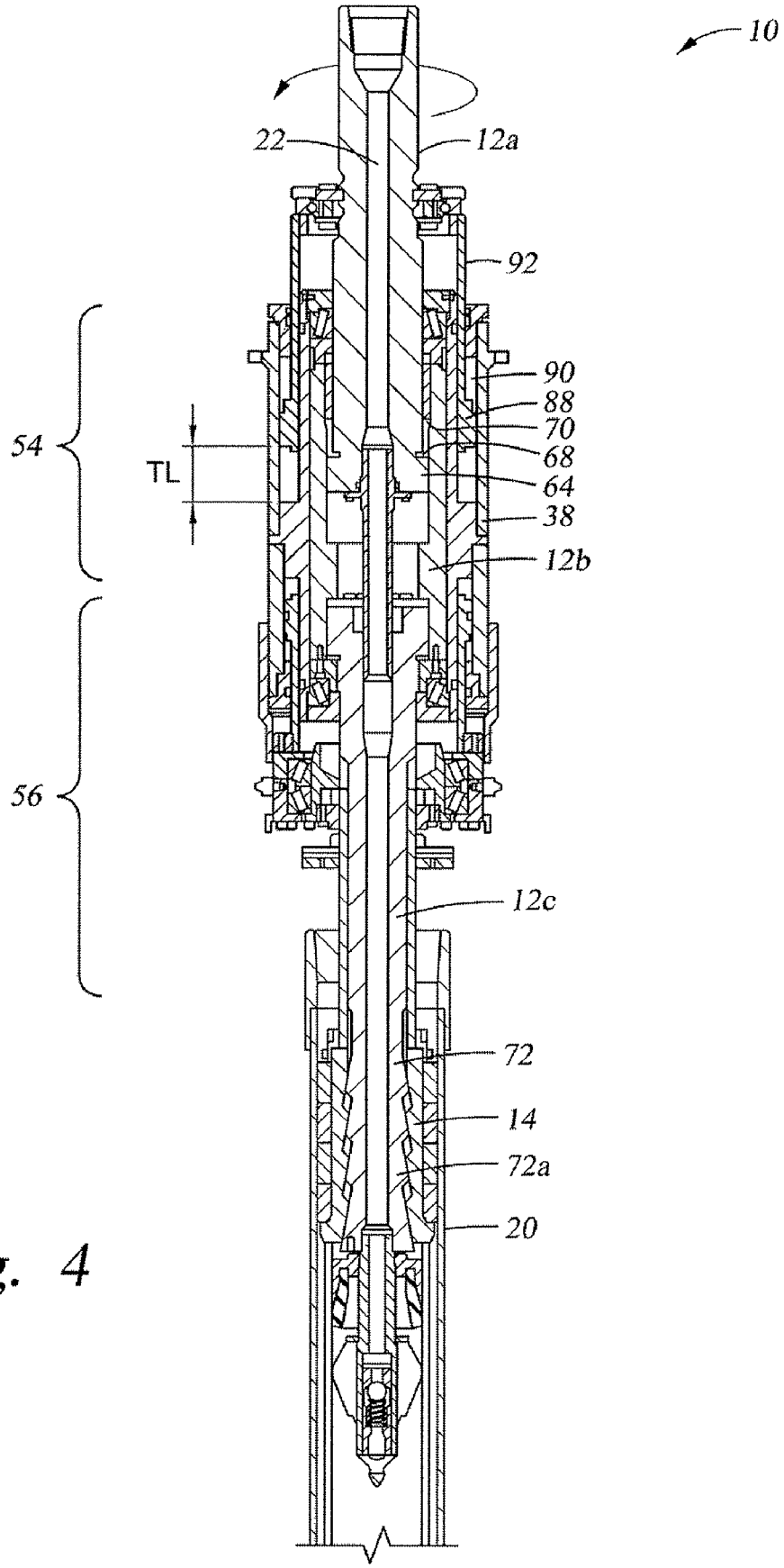
FIG. 4 is an elevation, sectional view of multipurpose running tool in another operational position.

Refer now to FIG. 4, wherein multipurpose tubular running tool 10 is illustrated in the making-up position (e.g., for rotation of add-on casing 20). Compensator 54 is illustrated at a mid-stroke position relative to piston head 88 relative to cylinder 90. In this embodiment, compensator 54 is providing tool compensation. Piston head 88 is shown positioned between the opposing ends of cylinder 90. Mid-mandrel 12*b* is axially positioned relative to upper mandrel 12*a* such that shoulder 68 of upper mandrel 12*a* is spaced apart from face 70. It is noted that the distance between shoulder 68 and face 70 may be equal to or greater than the thread loss "TL" distance illustrated in FIG. 1A.

Multipurpose tubular running tool 10 is described making up the threaded connection between add-on casing 20 and casing string 18. Casing string 18 is held rotationally and axially stationary by spider 44 (FIG. 1A). Mandrel assembly 12 is rotated, via top drive 16, thereby transferring the rotation to add-on casing 20 and threadedly connecting pin end 46 to box coupling 48 of casing string 18. The threaded connection is made while top drive 16 is maintained in a vertically stationary position. During makeup of the threaded connection, add-on casing travels vertically away from top drive 16 the distance of thread-loss "TL". The axial movement of casing add-on tubular 20 overcomes the upward biased force that is provided by compensator 54 to the lower mandrel portions (e.g., tool compensation load) axially pulling the lower portion of multipurpose tubular running tool 10 down relative to top drive 16 and upper mandrel 12*a*.

Figure 5:
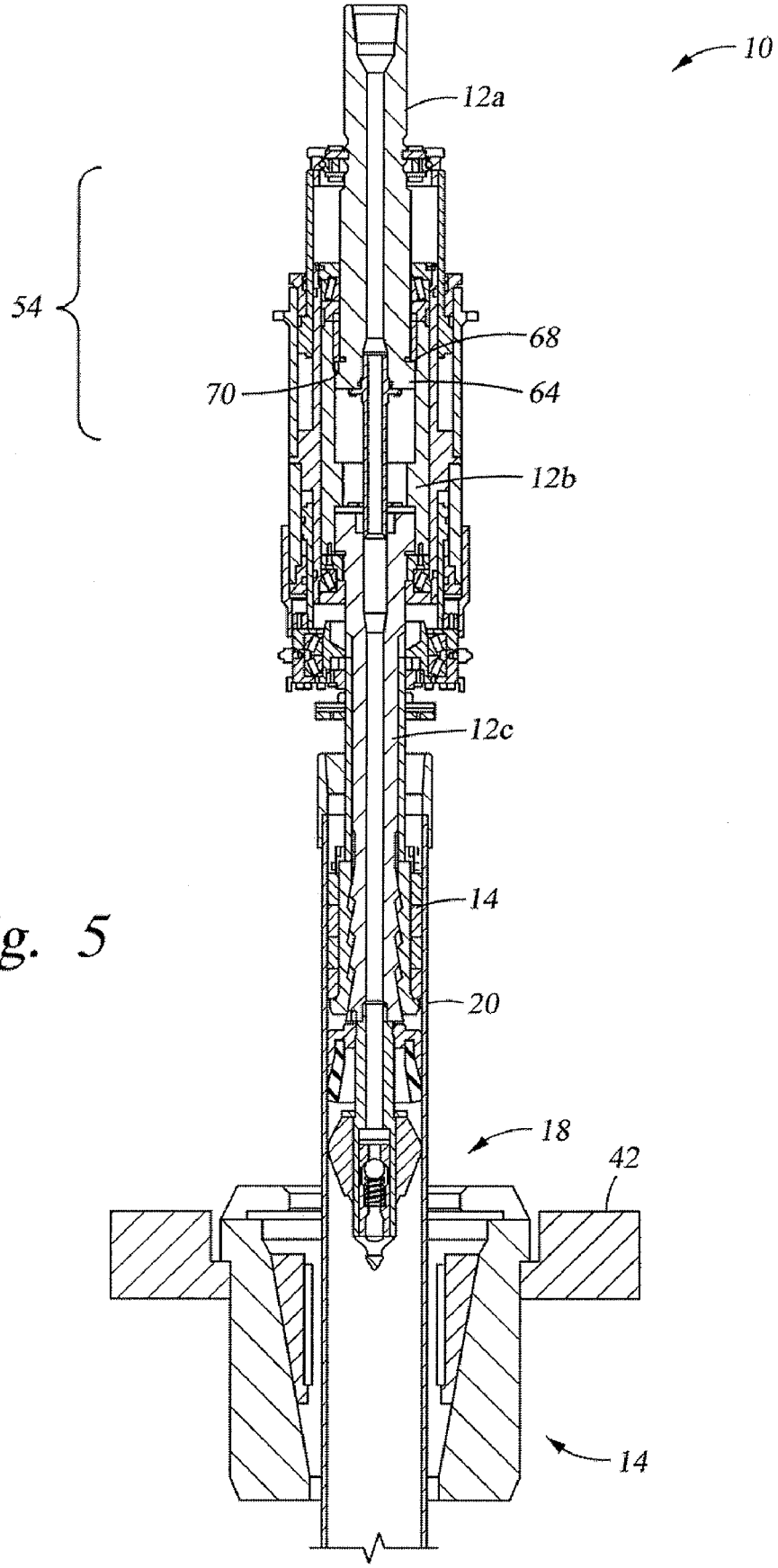
FIG. 5 is an elevation, sectional view of multipurpose running tool in another operational position.

Refer now specifically to FIG. 5, wherein multipurpose tubular running tool 10 is illustrated in a lifting position. Slips 14 are engaged with casing string 18 via add-on string 20. Compensator 54 is disposed in the extended position, wherein shoulder 68 of 12*a* is contacting face 70 of load retainer 66 thereby forming a load path from the lower portion of the tool to the top drive system. For example, the load path extends from lower mandrel 12*c* through mid-mandrel 12*b* and through upper mandrel 12*a* via the contact of shoulder 68 and face 70. The load path is provided through the rotational portion of the makeup tool, for example, mandrel assembly 12. In the lifting position, as illustrated in FIG. 5, casing string 18 may be raised via multipurpose tubular running tool 10. Spider 44 may be disengaged from casing string 18 and casing string 18 may be lowered further into wellbore 40.

Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A tubular running tool, the tool comprising:

a mandrel assembly having an upper mandrel, a lower mandrel and a mid-mandrel, wherein the upper mandrel, the lower mandrel and the mid-mandrel rotate in unison;

the lower mandrel having a tubular gripping portion;

the mid-mandrel forming a bore between a top end and a bottom end, the top end forming a slip-joint with the upper mandrel; and a compensation actuator functionally connecting the upper mandrel and the lower mandrel to affect axial movement of the lower mandrel relative to the upper mandrel, wherein the compensation actuator is rotationally independent of the mandrel assembly.

2. The tool of claim 1, wherein the mandrel assembly forms a fluid flow path through its length, and further comprising a stinger forming a portion of the fluid flow path extending between the upper mandrel and the lower mandrel.

3. The tool of claim 1, further comprising:

slips disposed with the tubular gripping portion; and a slip actuator to move the slips into gripping engagement with a tubular.

4. The tool of claim 3, wherein the slip actuator is rotationally independent of the mandrel assembly.

5. The tool of claim 3, wherein the slips internally grip the tubular.

6. The tool of claim 1, further comprising a tubular manipulator rotationally independent of the mandrel assembly.

7. The tool of claim 1, further comprising:

a slip actuator operationally connected with the tubular gripping portion to move slips into gripping engagement with a tubular; and a housing disposing the slip actuator and the compensation actuator.

8. The tool of claim 7, wherein the housing is disposed about the mid-mandrel.

9. The tool of claim 7, wherein the mandrel assembly forms a fluid flow path through its length, and further comprising a stinger forming a portion of the fluid flow path extending between the upper mandrel and the lower mandrel.

10. The tool of claim 9, wherein the housing is disposed about the mid-mandrel.

11. A tubular running tool, the tool comprising:

a mandrel assembly having an upper mandrel, a lower mandrel and a mid-mandrel, wherein the upper mandrel, the lower mandrel and the mid-mandrel rotate in unison;

the lower mandrel having a tubular gripping portion;

a slip disposed with the tubular gripping portion;

the mid-mandrel forming a bore between a top end and a bottom end, the top end forming a slip-joint with the upper mandrel; and an actuator mechanism disposed with the mid-mandrel, the actuator mechanism comprising a compensation actuator and a slip actuator;

wherein the compensation actuator functionally connects the upper mandrel and the lower mandrel to affect axial movement of the lower mandrel relative to the upper mandrel and the slip actuator moves the slip into gripping engagement with a tubular; and wherein the actuator mechanism is rotationally independent of the mandrel assembly.

12. The tool of claim 11, further comprising a tubular manipulator connected with the mandrel assembly, the tubular manipulator having a pick-up elevator.

13. The tool of claim 11, wherein the actuator mechanism comprises a housing, the housing disposed about the mid-mandrel.

14. The tool of claim 13, further comprising a tubular manipulator connected with the mandrel assembly, the tubular manipulator having a pick-up elevator.

15. The tool of claim 11, wherein the mandrel assembly forms a fluid flow path through its length, and further comprising a stinger forming a portion of the fluid flow path extending between the upper mandrel and the lower mandrel.

16. The tool of claim 15, further comprising a tubular manipulator connected with the mandrel assembly, the tubular manipulator having a pick-up elevator.

17. The tool of claim 16, wherein the tubular manipulator is rotationally independent of the mandrel assembly.

18. A method for connecting a tubular member to a tubular string, comprising:

using a tubular running tool comprising a mandrel assembly having an upper mandrel, a lower mandrel and a mid-mandrel; the lower mandrel having a tubular gripping portion; a slip disposed with the tubular gripping portion; the mid-mandrel forming a bore between a top end and a bottom end, the top end forming a slip-joint with the upper mandrel; and an actuator mechanism disposed with the mid-mandrel, the actuator mechanism comprising a compensation actuator and a slip actuator; wherein the compensation actuator functionally connects the upper mandrel and the lower mandrel to affect axial movement of the lower mandrel relative to the upper mandrel and the slip actuator moves the slip into gripping engagement with a tubular;

connecting the upper mandrel to a shaft of a top drive;

positioning a pin end of an add-on tubular with a box coupling of a tubular string, the tubular string suspended in a wellbore from a spider;

actuating the slip actuator to grippingly engage the add-on tubular;

threading the pin end into the box coupling by applying torque and rotation from the top drive to the add-on tubular via the mandrel assembly;

maintaining the actuating mechanism in a rotationally stationary position while threading the pin end with the box coupling;

maintaining the top drive and the upper mandrel in a vertically stationary position while threading the pin end into the box coupling and allowing the lower mandrel to move axially downward as the pin end is threaded into the box coupling;

lifting the interconnected add-on tubular and tubular string by moving the top drive and upper mandrel vertically; and disengaging the spider from the tubular string.

19. The method of claim 18, wherein the mandrel assembly forms a fluid flow path through its length, and further comprising a stinger forming a portion of the fluid flow path extending between the upper mandrel and the lower mandrel.

20. The method of claim 18, wherein the positioning the pin end of the add-on tubular is provided by a tubular manipulator functionally connected with the mandrel assembly.

21. The method of claim 20, wherein the tubular manipulator is disposed with the mandrel assembly.

22. The method of claim 21, wherein the tubular manipulator remains rotationally stationary while the mandrel assembly rotates.

23. The method of claim 22, wherein the tubular manipulator is connected to the actuator mechanism.

24. The method of claim 18, wherein the positioning the pin end of the add-on tubular comprises:

gripping the add-on tubular with a tubular manipulator;

raising the top drive and tubular manipulator relative to the tubular string;

swinging the add-on tubular via the tubular manipulator to a position substantially aligned between the mandrel assembly and the tubular string; and lowering the top drive and the tubular manipulator relative to the tubular string, positioning the pin end of the add-on in a stab-in position relative to the box coupling.

25. A tubular running tool, the tool comprising:

a mandrel assembly having an upper mandrel, a lower mandrel and a mid-mandrel, wherein the upper mandrel, the lower mandrel and the mid-mandrel rotate in unison;

the lower mandrel having a tubular gripping portion;

slips disposed with the tubular gripping portion;

a slip actuator to move the slips into gripping engagement with a tubular, wherein the slip actuator is rotationally independent of the mandrel assembly;

the mid-mandrel forming a bore between a top end and a bottom end, the top end forming a slip-joint with the upper mandrel; and a compensation actuator functionally connecting the upper mandrel and the lower mandrel to affect axial movement of the lower mandrel relative to the upper mandrel.

26. The tool of claim 25, wherein the mandrel assembly forms a fluid flow path through its length, and further comprising a stinger forming a portion of the fluid flow path extending between the upper mandrel and the lower mandrel.

27. The tool of claim 25, wherein the compensation actuator is rotationally independent of the mandrel assembly.

28. The tool of claim 25, wherein the slips internally grip the tubular.

29. The tool of claim 25, further comprising a tubular manipulator having a pick-up elevator, wherein the tubular manipulator is rotationally independent of the mandrel assembly.

30. The tool of claim 25, further comprising a housing disposing the slip actuator and the compensation actuator.

31. The tool of claim 30, wherein the housing is disposed about the mid-mandrel.

32. The tool of claim 30, wherein the mandrel assembly forms a fluid flow path through its length, and further comprising a stinger forming a portion of the fluid flow path extending between the upper mandrel and the lower mandrel.

33. The tool of claim 32, wherein the housing is disposed about the mid-mandrel.

34. A tubular running tool, the tool comprising:

a mandrel assembly having an upper mandrel, a lower mandrel and a mid-mandrel, wherein the upper mandrel, the lower mandrel and the mid-mandrel rotate in unison;

the lower mandrel having a tubular gripping portion;

a slip disposed with the tubular gripping portion;

the mid-mandrel forming a bore between a top end and a bottom end, the top end forming a slip-joint with the upper mandrel; and an actuator mechanism disposed with the mid-mandrel, the actuator mechanism comprising a compensation actuator and a slip actuator;

wherein the compensation actuator functionally connects the upper mandrel and the lower mandrel to affect axial movement of the lower mandrel relative to the upper mandrel and the slip actuator moves the slip into gripping engagement with a tubular; and wherein the actuator mechanism comprises a housing, the housing disposed about the mid-mandrel.

35. The tool of claim 34, further comprising a tubular manipulator connected with the mandrel assembly, the tubular manipulator having a pick-up elevator.

36. The tool of claim 34, wherein the actuator mechanism is rotationally independent of the mandrel assembly.

37. The tool of claim 34, wherein the mandrel assembly forms a fluid flow path through its length, and further comprising a stinger forming a portion of the fluid flow path extending between the upper mandrel and the lower mandrel.

38. The tool of claim 37, further comprising a tubular manipulator connected with the mandrel assembly, the tubular manipulator having a pick-up elevator.

39. The tool of claim 38, where in the tubular manipulator and the actuating member are rotationally independent of the mandrel assembly.

* * * * *